US007760087B2

(12) United States Patent
Staffin

(10) Patent No.: US 7,760,087 B2
(45) **Date of Patent: *Jul. 20, 2010**

(54) FLUIDIZED BED TECHNOLOGY FOR SECURITY ENHANCEMENT

(75) Inventor: H. Kenneth Staffin, Colonia, NJ (US)

(73) Assignee: Procedyne Corp., New Brunswick, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/215,258

(22) Filed: Jun. 25, 2008

(65) Prior Publication Data

US 2008/0266086 A1 Oct. 30, 2008

Related U.S. Application Data

(63) Continuation of application No. 11/177,623, filed on Jul. 8, 2005, now Pat. No. 7,405,654.

(51) Int. Cl.
*G08B 13/00* (2006.01)

(52) U.S. Cl. ..... 340/541; 244/118.5

(58) Field of Classification Search ..... 340/541; 244/118.5, 30; 102/517; 222/61, 630; 109/3
See application file for complete search history.

(56) References Cited

U.S. PATENT DOCUMENTS

| | | | | |
|---|---|---|---|---|
| 5,206,896 | A * | 4/1993 | Hargest | 378/180 |
| 7,405,654 | B2 * | 7/2008 | Staffin | 340/541 |
| 2007/0007384 | A1 * | 1/2007 | Sliwa | 244/30 |

* cited by examiner

*Primary Examiner*—Davetta W Goins
*Assistant Examiner*—Hoi C Lau
(74) *Attorney, Agent, or Firm*—Gottlieb, Rackman & Reisman, P.C.

(57) ABSTRACT

An improved system and methods for increasing security at sensitive locations from unwanted third parties through the use of fluidized granular solids.

27 Claims, 6 Drawing Sheets

FLUIDIZED BED TECHNOLOGY FOR SECURITY ENHANCEMENT

RELATED APPLICATION

This application is a continuation of application Ser. No. 11/177,623, filed on Jul. 8, 2005 and now issued as U.S. Pat. No. 7,405,654.

FIELD OF THE INVENTION

The present invention relates generally to a method and apparatus for increasing the security at sensitive locations such as plant sites, buildings, utility sites and military installations, and relates more specifically to an improved method and apparatus for increasing security utilizing fluidized granular solids.

BACKGROUND OF THE INVENTION

The enhancement of security at sensitive locations has always been a concern through out modern history. At the present time, methods of limiting, controlling, and/or monitoring access of vehicles and personnel to buildings and sites typically include fences, access gates, guardhouses, barricades and related obstacles. Commercially available solutions also include sliding gates, drop bars, bollards, anti-ram walls, hydraulic wedges, hydraulic rising beams, retractable bollards, tire shredders, and ditches.

When a situation involves the potential of forced entry or secret unauthorized entry by personnel on foot or inside vehicles, particularly when aggressive unauthorized entry is involved, the typical approach involved armed personnel, impenetrable fences or gates and/or barricades. This approach has proven to be inadequate in many situations such as those involving people and vehicles both of which may be equipped with explosives.

An additional limitation of these approaches has been circumstances involving faulty assessments of the intention of the intrusion, and/or miscommunications leading to uncertainties. As a result of these problems, personal injury and/or significant damage to vehicles can easily result in unwanted fatalities and costly material loss.

In view of the above, there is a need in the art for enhanced security systems for sensitive locations for inhibiting access by unwanted third parties. Accordingly, it is an object of the present invention to provide an enhanced security systems as well as methods of inhibiting access to sensitive locations by unwanted third parties.

SUMMARY OF THE INVENTION

The present invention provides a security system for inhibiting unauthorized entry by a third party to a location. The system includes a defined surface area extending from a location that is adapted for movement of personnel to or from the location. A first enclosure is disposed in the defined surface area and has an open perimeter substantially parallel and proximal to the defined surface area. In a preferred embodiment, a retaining structure is disposed along the open perimeter of the first enclosure to inhibit collapse of the defined surface area. A majority of the first enclosure is disposed below the defined surface area. In a preferred embodiment, the open perimeter of the first enclosure is substantially flush to the surface of the defined surface area. In another preferred embodiment, the defined surface area is substantially planar.

A fluid bed configuration is disposed in the first enclosure, which includes a gas distribution piping array and a plurality of fluidizable granular solids in a surrounding relationship to the gas distribution piping array. In a preferred embodiment, gas injection nozzles are fluidly connected to the gas distribution piping array. A fluidizing gas means is fluidly connected to the gas distribution piping array to provide a fluidizing gas (e.g., air). Preferably, the fluidizing gas means is disposed in a second enclosure having a volume less than the first enclosure.

The present invention also provides a method of fabricating a security system for inhibiting unauthorized entry by a third party to a location. The method includes the following elements: providing a defined surface area extending from a location that is adapted for movement of personnel to and from the location; disposing a first enclosure in the defined area, the first enclosure having an open perimeter substantially parallel and proximal to the defined surface area and a majority of the first enclosure being disposed below the defined surface area; disposing in the first enclosure a fluid bed configuration, the fluid bed configuration including a gas distribution piping array and a plurality of fluidizable granular solids in a surrounding relationship to the gas distribution piping array; and fluidly connecting a fluidizing gas means to the gas distribution piping array so that fluidizing gas is provided to the piping array to fluidize the granular solids. Preferably, the open perimeter of the first enclosure is substantially below or flush to the planar surface of the defined area. In another preferred embodiment, the fluidizing gas means is disposed in a second enclosure having a volume less than the first enclosure.

In addition, the present invention provides a method for inhibiting movement by an unauthorized third party at a location. The method includes providing a security system for inhibiting unauthorized entry by a third party. The security system includes a defined surface area extending from a location that is adapted for movement of personnel to or from the location. The system also includes a first enclosure disposed in the defined surface area. The first enclosure has an open perimeter substantially parallel and proximal to the defined surface area and a majority of the first enclosure is disposed below the defined surface area. A fluid bed configuration is disposed in the first enclosure. The fluid bed configuration includes a gas distribution piping array, a plurality of fluidizable granular solids in a surrounding relationship to the gas distribution piping array, and a fluidizing gas means fluidly connected to the gas distribution piping array. The method also includes detecting the presence of the unauthorized third party and fluidizing the fluid bed configuration so that movement of the unauthorized third party is inhibited when the third party enters the open perimeter of the first enclosure. Preferably, the bed is defluidized once the movement of the unauthorized third party is inhibited.

Advantageously, the present invention through the use of fluidized granular solids provides an enhanced security system as well as methods for inhibiting movement of an unwanted third party at a location while avoiding the use of potentially lethal force common with security measures currently in use at sensitive locations. As a result, personal injury, loss of life and material loss can be minimized in those situations where unauthorized access to or from a location is attempted. These and other advantages of the present invention will become more apparent to those skilled in the art from the description set forth below.

DETAILED DESCRIPTION OF THE INVENTION

Figure 1A:
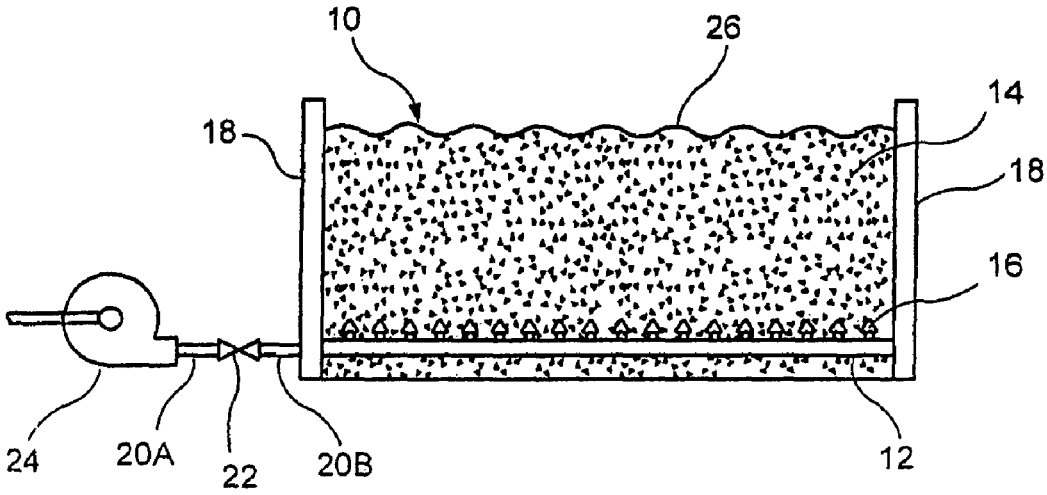
FIG. 1A is a cross-sectional view of a fluid bed configuration in a defluidized state.

The present invention provides a security system and methods for inhibiting unauthorized movement by a third party to or from a location where ingress or egress is to be restricted. The present invention reduces, and in some situations eliminates, the deficiencies in the current state of the art.

The security system of the present invention provides a first enclosure disposed in a defined surface area extending from a location for movement of personnel to and from the location. A fluidized bed configuration is disposed in the first enclosure. This system functions to inhibit the movement of an unauthorized third party. Under normal conditions, the fluidized bed within the defined surface area is maintained in a defluidized state allowing personnel to traverse an open perimeter of the first enclosure that is disposed in the defined surface area. If suspicious behavior is detected, a fluidizing gas means is activated causing gas to be fed to a gas distribution piping array within the fluid bed configuration to fluidize the granular solids. Fluidization of the granular solids typically occurs in a matter of seconds. As a result of fluidization, a third party (e.g., personnel) traversing the open perimeter of the first enclosure sink into the fluidized bed and become at least partially submerged. The granular solids are thereafter defluidized resulting in the third party being immobilized in the bed of granular solids.

In accordance with the invention, personnel are defined as anything that can move to or from a location along a defined surface area. Representative examples of personnel include, but are not limited to, an individual, a group of individuals, a vehicle or a group of vehicles, animals, or any mobile device. Vehicles in this context can be either remotely-operated or manually-operated.

A third party is any personnel whose movement to or from a location should be potentially restricted. Representative examples of third parties to be restricted from a location include, but are not limited to, terrorists, car bombs, truck bombs, suicide bombers, rioters, prisoners, protestors, foreign soldiers and any combination thereof.

A location is any site where personnel seek ingress or egress to the site. Representative examples of a location include, but are not limited to, buildings, government facilities, military facilities, correctional facilities, commercial processing facilities, energy generating facilities, water reservoirs, medical facilities, airports, or dams.

A defined surface area is any two-dimensional surface defined by a boundary used by personnel to move to or from a location. In a preferred embodiment, a defined surface area is a roadway, a pathway, a walkway or any other means used for movement or travel by personnel to or from a location. Representative examples of a defined surface area include, but are not limited to, areas inside or outside buildings, areas surrounding facilities such as prisons, at the end of airport runways or runaway truck ramps on major highways. The defined surface area can be substantially planar, substantially inclined, substantially elevated or any combination thereof. Preferably, the defined surface area is substantially planar.

Referring now to the drawings in detail wherein like numerals indicate like elements throughout the several views, FIG. 1A is a cross-sectional view of a fluid bed configuration 10 disposed in a first enclosure 18. Fluid bed configuration 10 includes gas distribution piping array 12 and plurality of fluidizable granular solids 14 in a surrounding relationship to gas distribution piping array 12. First enclosure 18 has an open perimeter 26 substantially parallel and proximal to a defined surface area (not shown) adapted for movement of personnel to or from a location. A majority of first enclosure 18 is disposed below the defined surface area. The perimeter 26 of first enclosure 18 is preferably substantially flush to the surface of the defined surface area.

As shown in FIG. 1A, first enclosure 18 is shown as a rectangular configuration. However, other geometric configurations can be used. Granular solids 14 are disposed in first enclosure 18 and are shown in a defluidized state. Gas distribution piping array 12 having gas injection nozzles 16 attached thereto is disposed in fluidizable granular solids. Preferably, as shown in FIG. 1A, fluidizing gas means 24 is fluidly connected to gas distribution piping array 12 and introduces gas, such as air, into gas distribution piping array 12 through discharge and inlet pipes 20A, 20B, respectively. Fluidizing gas means 24 can be any means of generating and transferring a flow of gas into gas distribution piping array 12. Representative examples of a fluidizing gas means include, but are not limited to, an air compressor, a pressurized gas tank, a blower or any combination thereof. Preferably, gas distribution piping array 12 is provided with a control valve 22 that regulates the flow of gas into the array. In one preferred embodiment, fluidizing gas is maintained in a pressurized tank fluidly connected to an air compressor. For example, a compressor having at least 5 horsepower (HP) can used in standby to assure that the tank is maintained at full capacity.

Figure 1B:
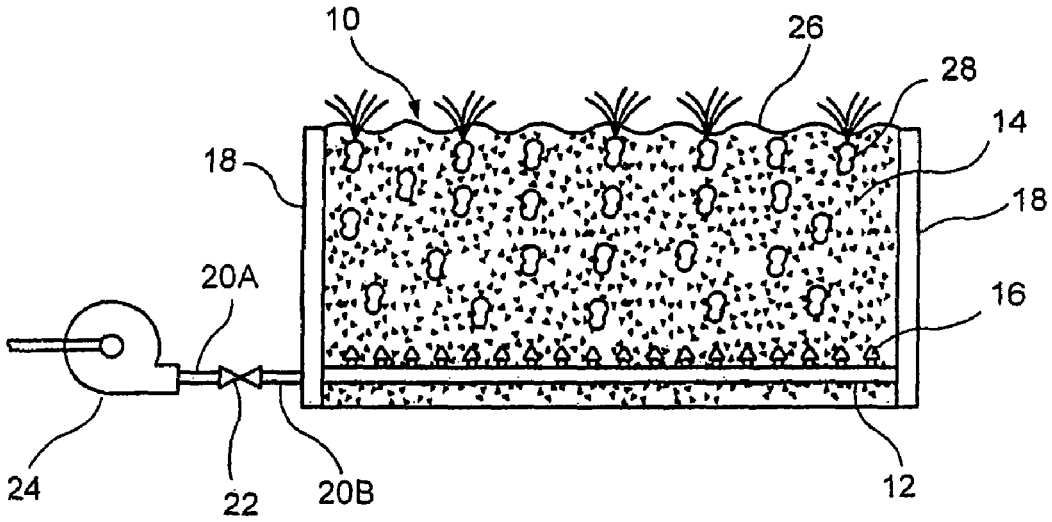
FIG. 1B is a cross-sectional view of a fluid bed configuration in a fluidized state.

FIG. 1B is a cross-sectional view of fluid bed configuration 10 (shown in FIG. 1A) in a fluidized state. When granular solids 14 of the fluid bed configuration are fluidized, separation of granular solids 14 occurs. When the flow is increased sufficiently, void spaces 28, also termed pseudo bubbles, are formed in the fluidized medium where they rise to the surface and release the gas pocket.

Figure 2:
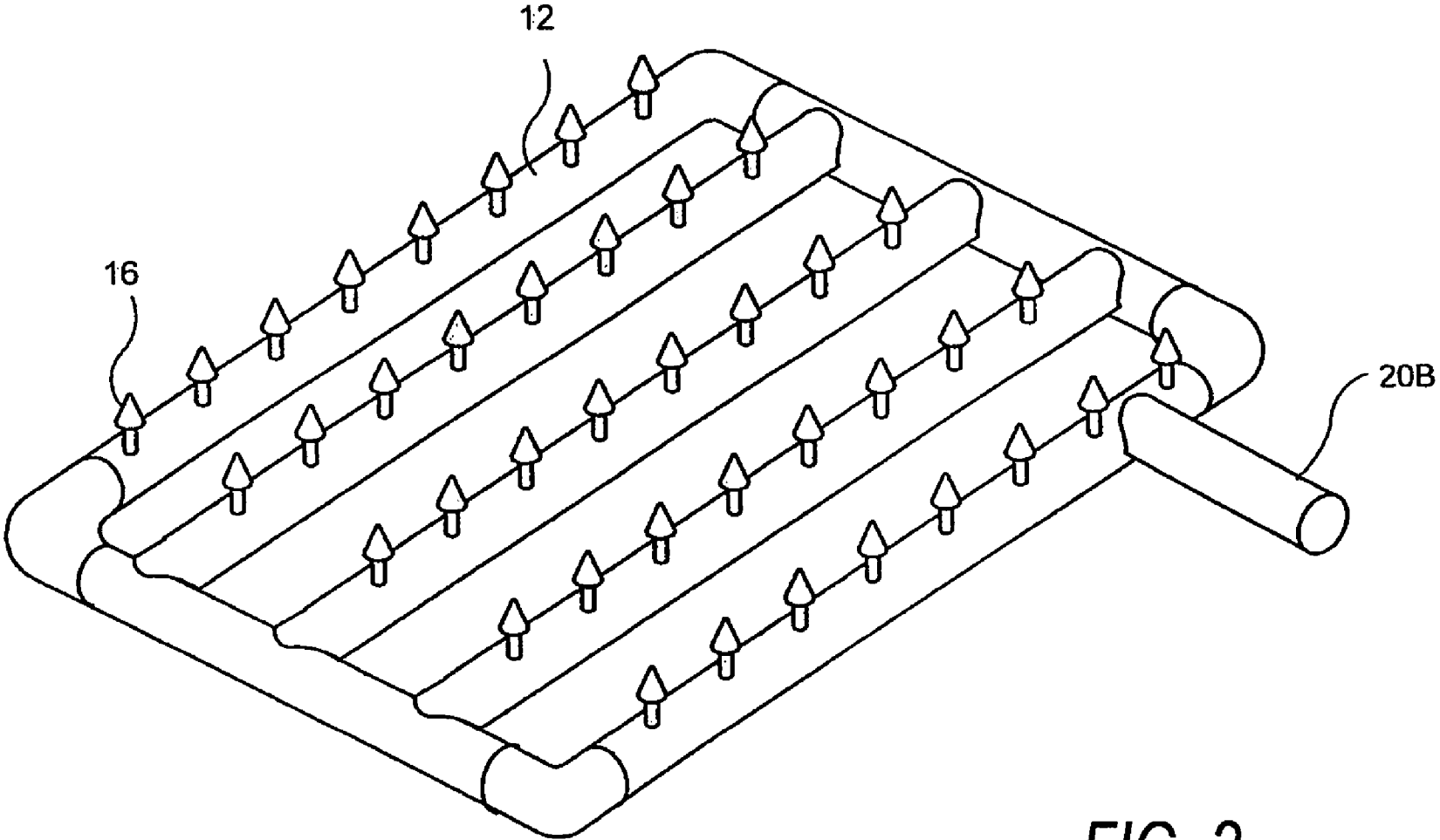
FIG. 2 is a perspective view of an air piping array configuration to be used in accordance with the present invention.

FIG. 2 is a perspective view of gas distribution piping array 12. However, as will be apparent to those skilled in the art, other gas distribution piping array configurations can also be used. Gas injection nozzles 16, also termed tuyeres, have the ability of uniformly distributing a gas flow vertically into fluidizable granular solids 14 (not shown) while preventing granular solids 14 from flowing into gas distribution piping array 12. Gas injection nozzles 16 are spaced apart along gas distribution piping array 12. In one preferred embodiment, gas injection nozzles 16 are uniformly spaced apart, such as 4 to 8 inches apart.

Figure 3:
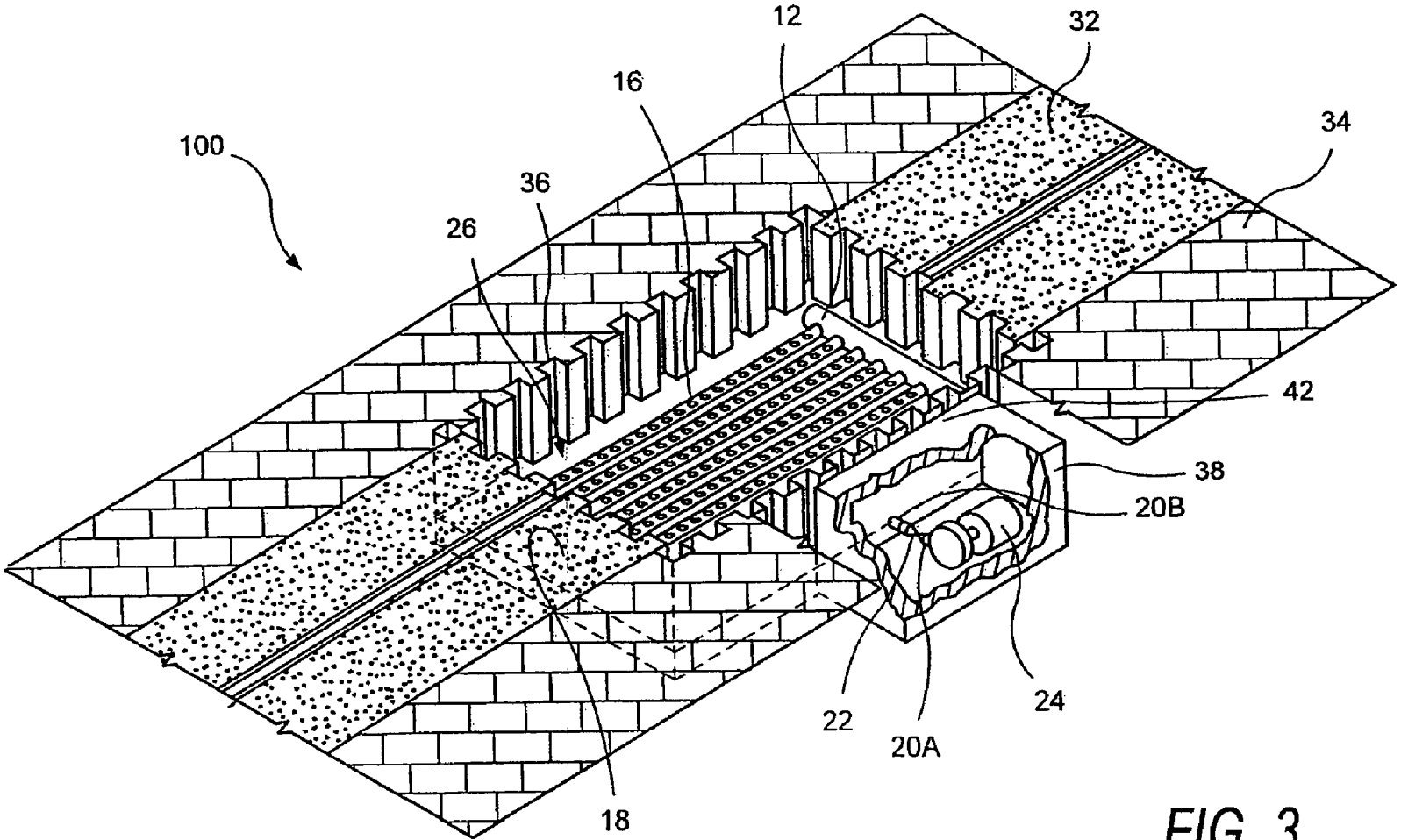
FIG. 3 is a perspective view of a roadway adapted with a fluid bed configuration.

FIG. 3 is a perspective view of a preferred embodiment depicting the security system of the invention. As shown in FIG. 3, security system 100 includes a defined surface area (shown as roadway 32) provided with first enclosure 18. First enclosure 18 is disposed in the earth below roadway 32 extending from a location (not shown). Fluid bed configuration 10 is disposed in first enclosure 18. First enclosure 18 has an open perimeter 26 substantially parallel and proximal to a defined surface area (shown as roadway 32) and a majority of first enclosure 18 is disposed below the defined surface area. In a preferred embodiment, first enclosure 18 is sufficiently wide to extend the width of roadway 32 and roadway shoulder 34. The length of first enclosure 18 depends upon the details of the particular security objective involved. For example, the length of the first enclosure 18 will be greater if the third party travels at higher speed such as a truck or car as compared to a pedestrian. As shown in FIG. 3, retaining structure 36 is, preferably, disposed along the perimeter walls of first enclosure 18 to inhibit collapse of the earth of the excavation in which first enclosure 18 is formed. Retaining structure 36 can be any material of construction suitable for the purpose of inhibiting the collapse the earth surrounding of enclosure 18. Representative examples include, but are not limited to, corrugated steel, fiberglass, ceramic block, wood panels, wood timbers or poured concrete.

FIG. 3 also depicts a second enclosure 38 provided for housing fluidizing gas means 24. As depicted in FIG. 3, second enclosure 38 is adjacent to first enclosure 18. However, second enclosure 38 does not have to be located adjacent to first enclosure 18 and can be placed wherever feasible. Discharge pipe 20A exiting from fluidizing gas means 24 is fluidly connected to control valve 22 which in turn is fluidly connected to inlet pipe 20B. Control valve 22 allows for the adjusting of the flow of gas from fluidizing gas means 24 to distribution piping array 12 to achieve proper fluidization. Retaining structure 36 is disposed along the perimeter wall of second enclosure 38 to inhibit collapse of a defined surface area. Second enclosure 38 has a cubic volume preferably less than first enclosure 18. Second enclosure 38 is preferably adapted with removable cover 42. Removable cover 42 can be removed for periodic maintenance of fluidizing gas means 24. Removable cover 42 is designed and fabricated to be sufficiently strong enough to withstand the weight of personnel traversing the defined surface area and to give the appearance that removable cover 42 is part of the defined surface area.

In accordance with the present invention, granular solids 14 preferably measure from about 40 to 100 US Mesh particle size, and more preferably from about 60 to 80 US Mesh particle size. As will be apparent to those of ordinary skill in the art, a variety of granular solids having different granular particle types, shapes, compositions or densities can also be used. In accordance with the invention, granular solids 14 are disposed in first enclosure 18 until the top surface of the bed is substantially parallel to the defined surface area.

Figure 4A:
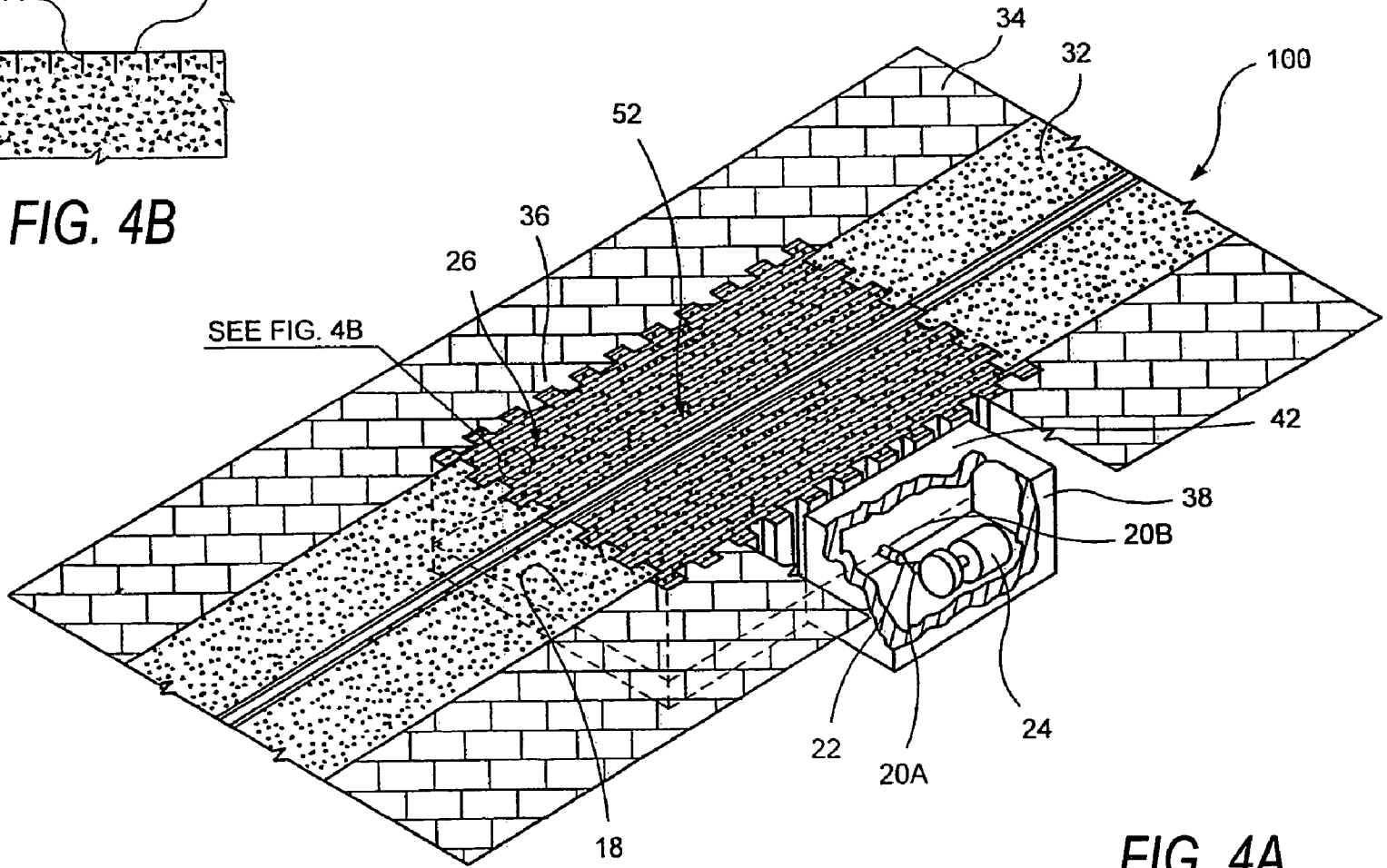
FIG. 4A is a perspective view of preferred embodiment of the security system of the present invention.
Figure 4B:
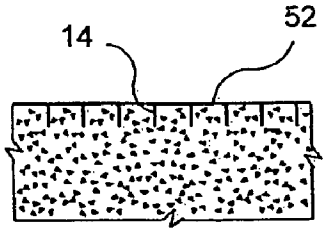
FIG. 4B is cross-sectional view of the support structure depicted in FIG. 4A.

In a preferred embodiment, as shown in FIG. 4, open perimeter 26 includes open support structure 52 (e.g., an open grating), is disposed on the plurality of fluidizable granular solids 14. Preferably, open support structure 52 is disposed substantially flush with the surface of roadway 32 such that it provides stability for personnel traversing the surface of roadway 32. However, as will be apparent to those skilled in the art, support structure 52 can also be disposed slightly above or below the surface of roadway 32. If support structure 52 is not provided, when personnel, such as in a vehicle, travels on roadway 32 and traverses open perimeter 26 that encompasses the defluidized bed of granular solids 14, the vehicle may exhibit sluggish driving characteristics typically experienced while driving on sand, such as a beach. Support structure 52 is provided to assist in lessening, and preferably eliminating, the potentially sluggish behavior exhibited by traversing a defluidized bed of granular solids 14. Likewise, support structure 52 improves the condition of the surface of the defluidized bed of granular solids 14 for normal personnel traffic. Support structure 52 is supported by the defluidized bed of granular solids configuration and, as shown in FIG. 4. Support structure 52 can be constructed of any material capable of withstanding the weight of personnel movement above it and has sufficient openings to provide open surface area to allow it to sink in the bed when the bed becomes fluidized. Preferably, support structure 52 is made of metal or metal alloy. More preferably, support structure 52 is a steel grating. Typically, a steel grating with an open surface area of from about 40 to 70% is used. In accordance with the present invention, a support structure open area is defined as the percent (%) horizontal area that is not blocked by the structural members comprising the support structure. In an alternative embodiment, a metal or metal alloy support structure having a sheet configuration with an open surface area of from perforations of about 40 to 70% disposed therein can be used.

Support structure 52 is preferably defined by a perimeter smaller than open perimeter 26 of first enclosure 18 so that the fluidization of the medium causes support structure 52 to fall into fluidized bed of granular solids 14 as personnel become submerged in fluidized bed of granular solids 14. Preferably, support structure 52 is adapted to fall at a rate equal to or greater than personnel traversing the granular solids 14 when fluidized. A cross-sectional view of support structure 52 is provided in FIG. 4A. As shown in FIG. 4A, a portion of support structure 52 can be partially disposed in the granular solids 14.

Figure 5A:
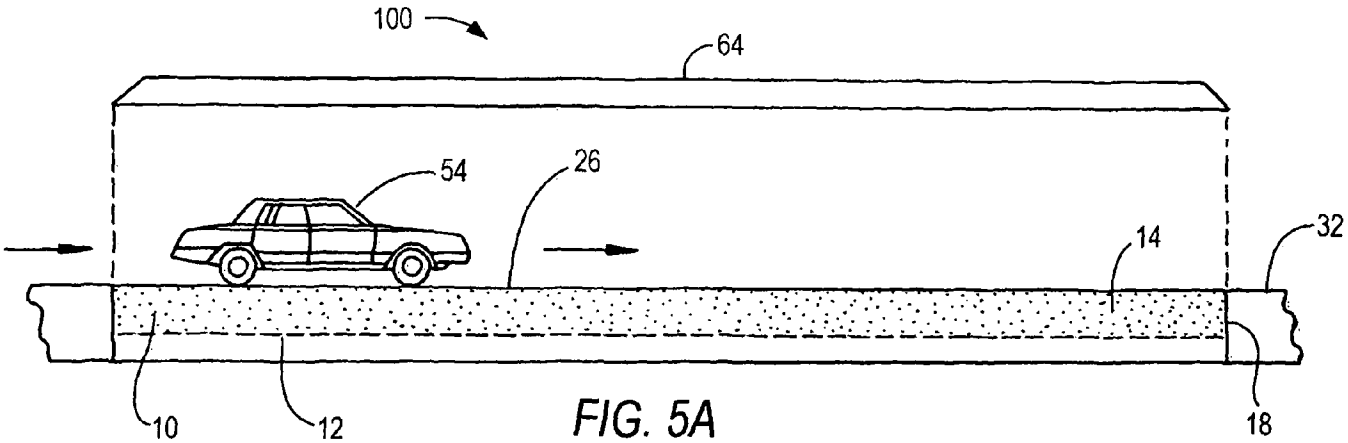
FIG. 5A is a side view of the security system in a section of roadway with the fluid bed configuration in a defluidized state.
Figure 5B:
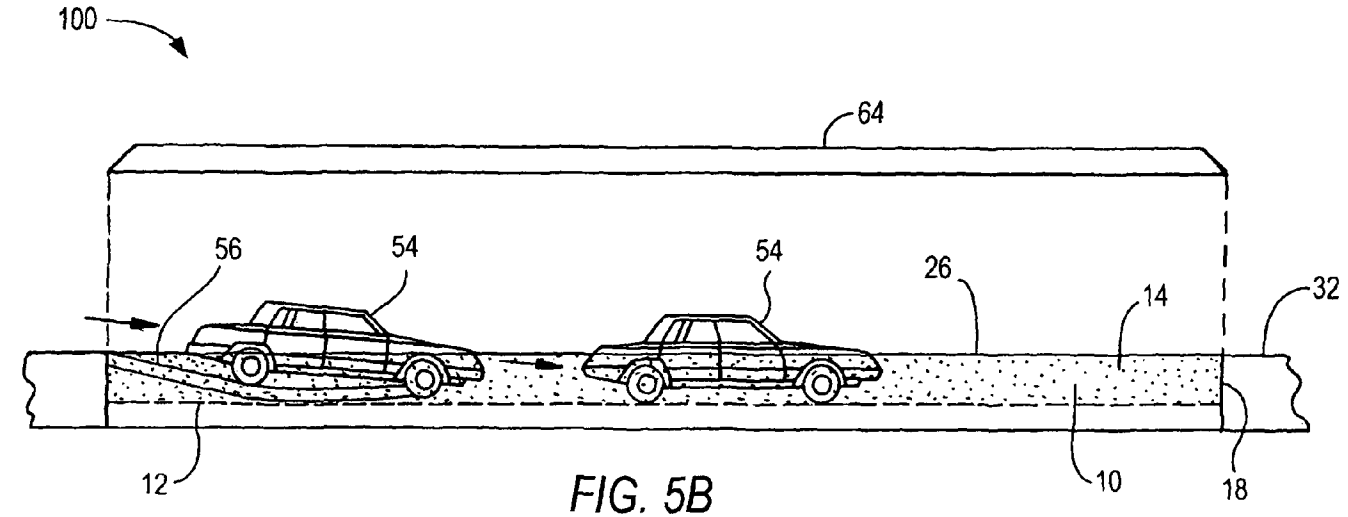
FIG. 5B is a side view of the security system in a section of roadway with the fluid bed configuration in a fluidized state.

FIG. 5A is a side view of a preferred embodiment of security system 100 for inhibiting unauthorized entry of a third party installed in a roadway. FIG. 5A depicts vehicle 54 proceeding at a normal speed along roadway 32 with no incident when granular solids 14 are in a defluidized state. However, as shown in FIG. 5B, when a suspicious vehicle approaches the area by either failing to slow down, speeding up or failing to obey instructions or signals from an assigned person such as a security guard, the defluidized bed of granular solids 14 of roadway 32 is be fluidized via piping array 12 upon activation of fluidizing gas means 24 (not shown). In a preferred embodiment, the bed is fluidized in less than 5 seconds, with less than 3 seconds being more preferred.

For example, when a signal is given by installed sensors or by the observation of a guard, gas means 24 is activated to fluidize granular solids 14 via piping array 12. Vehicle 54 upon entering open perimeter 26 will veer downward and enter the liquid-like medium created by fluidized granular solids 14. Entry of vehicle 54 into the fluidized medium will cause vehicle 54 to decelerate and eventually stop. Generally, vehicle 54 will become submerged to a level that prevents the doors of the vehicle from being easily opened. Preferably, vehicle 54 is submerged in the bed to a level just above the door panels and about several inches on to the door windows. Fluidizing gas means 24 is thereafter deactivated so that the bed of granular solids 14 is defluidized and returns to its original state. Preferably, the bed defluidizes in less than 8 seconds, with less than 6 seconds being preferred. The defluidization of the granular solids 14 traps vehicle 54 and its occupants in place because the doors cannot be fully opened when vehicle 54 becomes at partially buried in the bed to a sufficient depth. In a preferred embodiment, vehicle 54 is removed from the bed manually. In yet another preferred embodiment, vehicle 54 is removed from bed of granular solids 14 with proper lifting equipment by reactivating gas means 24 and refluidizing the bed. As used herein, proper lifting equipment can include, but is not limited to, two or more lifting straps submerged within bed of granular solids 14. The lifting straps can be connected to a hoist positioned above vehicle 54. Bed of granular solids 14 is fluidized and vehicle 54 can be removed by hoisting it up and out of the bed using the lifting straps. Fluidizing the bed after the lifting straps are in place reduces the lifting capacity needed to remove the vehicle from the bed.

The choice of fluidizing medium and its properties for granular solids 14 will determine the extent of the viscosity and density of the medium. As a result, the selection of granular solids 14 will affect the rate of deceleration and thus deceleration can be adjusted within a range to avoid extensive damage to the vehicle and its occupants. Another parameter to be considered is the size of fluidized bed configuration 10 to be provided within the defined surface area, which should be calculated when determining the size of the excavation. These parameters can easily be ascertained by one of ordinary skilled in the art following the teachings of the present invention.

In a preferred embodiment of the present invention, as shown in FIG. 5B, guiding structure 56 is disposed in the plurality of fluidizable granular solids 14 to control the descent of vehicle 54 upon entering fluidized bed 10 of security system 100. Preferably, guiding structure 56 is submerged in the bed of granular solids 14 at a position adjacent to the point of transition from roadway 32 to open perimeter 26. Guiding structure 56 preferably provided in the geometric shape of a ramp to act as a wheel guide for vehicle 54. Guiding structure 56 at least partially controls the path of vehicle 54 when it initially enters the bed of granular solids 14. Referring to FIG. 5B, guiding structure 56 is also preferably provided to facilitate the angle of penetration into granular solids 14 and the side to side movement of vehicle 54. Guiding structure 56 is preferably fabricated from metal such as perforated metal. Preferably, the perforated metal has at least 60% open area so its presence does not degrade the fluidization characteristics of fluid bed 10.

Figure 6A:
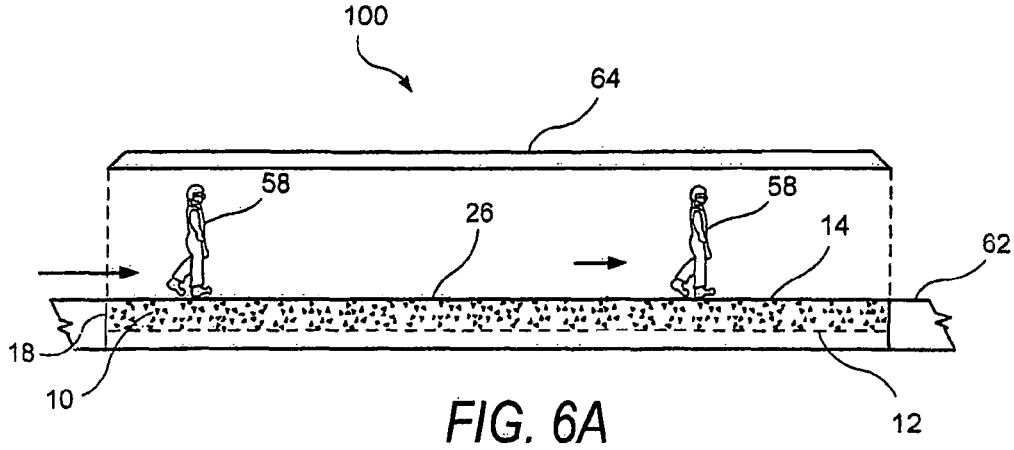
FIG. 6A is a side view of the security system in a section of walkway with the fluid bed configuration in a defluidized state.

In another preferred embodiment as shown in the side view depicted in FIG. 6A, security system 100 for inhibiting unauthorized entry of a third party is installed in a walkway. First enclosure 18 is disposed in walkway 62 extending from a location (not shown). Disposed in first enclosure 18 is fluid bed configuration 10 that includes piping array 12 surrounded by granular solids 14. Piping array 12 is fluidly connected to fluidizing gas means 24 (not shown). First enclosure 18 has an open perimeter 26 substantially parallel and proximal to the defined surface area (shown as walkway 62). Open perimeter 26 allows movement of personnel 58 to or from the location when granular solids 14 are in a defluidized state. Preferably, open perimeter 26 of walkway 62 is at least about 6 to 10 feet in width, at least about 10 to 15 feet in length while first enclosure 18 has a depth of at least about 2 to 5 feet.

Figure 6B:
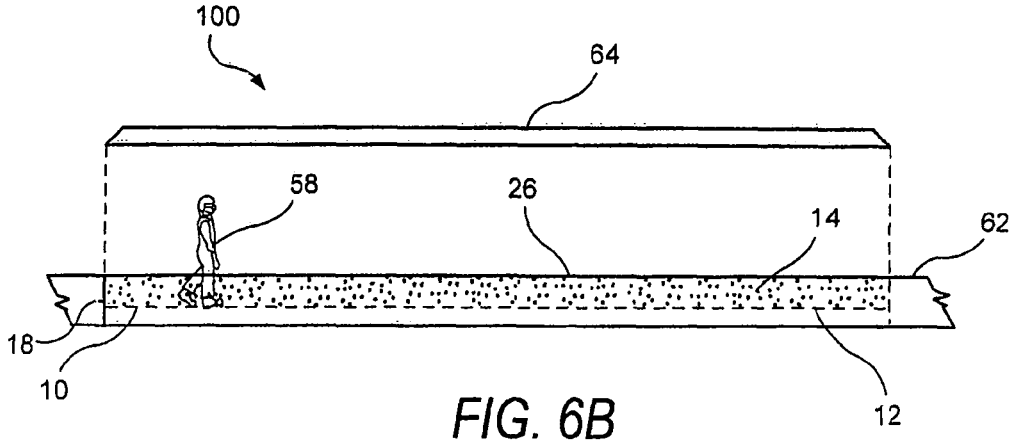
FIG. 6B is a side view of the security system in a section of walkway with the fluid bed configuration in a fluidized state.

Personnel 58 are able to traverse walkway 62 without difficulty as shown in FIG. 6A. However, when personnel moving along the walkway are suspected of attempting an unauthorized ingress or egress to the location (not shown) fluidization of granular solids 14 disposed in walkway 62 is activated. As shown in FIG. 6B, personnel 58 sink into granular solids 14 and become at least partially submerged. Preferably, fluidization of granular solids 14 and partial submergence of personnel 58 occurs in less than 4 seconds, with less than 2 seconds being more preferred. The fluidized density to achieve optimum submergence performance of a vehicle or person in the medium ranges preferably from about 60 lbs per cubic feet to 120 lbs per cubic feet.

In still another preferred embodiment, to protect bed of granular solids 14 in both roadway 32 and walkway 62, shield 64 is located above open perimeter 26 as shown in FIGS. 5A, 5B, 6A and 6B. Shield 64 is designed to protect granular solids 14 within open perimeter 26 from environmental elements. Representative examples of environmental elements include, but are not limited to, rain, snow or wind that could wet down the bed of particles and possibly cause a change in the properties of the fluidized medium.

In an alternative embodiment, heated, low-flow fluidizing gas is passed through granular solids 14 to prevent the penetration and settling of water into void spaces 28. Heated, low-flow fluidizing gas may be used in place of shield 64 and is generated with a heating means (not shown). Heating means can be any means of generating and transferring heat to a flow of gas. In accordance with this invention, low-flow fluidizing gas is defined as a flow of heated gas that flows at a level that avoids granular solids 14 becoming substantially fluidized. In a preferred embodiment, low-flow fluidizing gas is heated to less than about 150° F., and more preferably to less than about 100° F.

Without being limited to theory, it is believed that personnel with density greater than the density of the fluidized solids, upon entering the open perimeter of the fluidized bed, will sink and become at least partially submerged in the bed so as to inhibit movement. The behavior of personnel is similar to that of a heavy object dropped into a liquid phase. Thus, an unauthorized third party (e.g., an individual or vehicle) having a significantly greater density than the granular solids will sink into granular solids 14 as a result of gravity. Objects lower in density than the density of the fluidized granular solids 14, when placed on the surface of the fluidized bed will at least partially float in the fluidized bed in a manner similar to an object floating in a liquid phase.

The properties of the bed of granular particles such as the pseudo viscosity, fluidized bulk density, minimum fluidization velocity and pseudo hydraulic behavior are determined by the physical properties of the granular solids including particle density, particle shape, particle size, and particle size distribution, and the physical properties of the fluidizing gas including density, viscosity and fluidization velocity. In accordance with the present invention, the properties of the granular solids and the fluidizing velocity of the gas phase can be easily selected to achieve the needs of the particular security application. The determination of these properties is well within the ability of those of ordinary skill in the art following the teachings of the invention.

The following non-limiting examples illustrate the advantageous use of a fluidized bed of granular solids for immobilization of a third party.

Example 1

An experiment was conducted to determine the minimum depth of fluidized bed capable of demobilizing a walking person to the point where assistance is required to free the person from the fluid bed when the bed is fluidized. A fluid bed vessel 40 inches in diameter with a bed depth capacity from zero to 60 inches was employed for the test. The fluid bed vessel was filled to a bed depth, in a defluidized state, of one (1) foot above the gas distribution nozzles. Typical beach sand, i.e., silica dioxide particles having an average particle size of 50 U.S. Mesh, was used. With a bed depth of 1.0 feet, an adult person of 180 lbs. was standing on the defluidized bed and able to move in small steps. Abruptly, fluidizing air at a fluidizing rate of 25 feet/minute was fed to the gas distribution nozzles to fluidize the granular solids. In approximately 1 to 2 seconds, the person dropped the depth of 1 foot to the support grid located above the fluidizing nozzles. With the fluidization air on, the individual was able to move with difficulty which could be described as trying to walk in 1 foot deep mud. However, once the fluidizing air was turned off, movement was observed to be not possible. With great effort, the individual was able to lift vertically one leg out of the defluidized bed and place a foot on top of the sand. After this first step, the individual with great effort was then able to lift the second leg vertically so that the person was once again standing on the surface of the sand. The individual did not sustain any injury or discomfort upon being detained and trapped by the fluid bed. The experiment was repeated a second time with identical results.

Example 2

Following the procedure of Example 1, a fluid bed vessel with a defluidized bed depth two and one half feet (2.5 feet) above the gas distribution nozzles was employed. As in example 1, an individual weighing about 180 pounds was standing on the surface of the bed and able to move in small steps from side to side. Fluidizing air was then abruptly turned on at a fluidizing rate of 25 feet/minute. Upon fluidization, the individual dropped 2.5 feet to the support grid above the fluidizing nozzles in about 1 to 2 seconds. However, unlike in example 1, the individual could not advance significantly with the fluidizing air on but only shift from side to side in small increments. Once the fluidizing air was discontinued and the sand bed defluidized, the legs of the individual were observed to be completely immobilized. The individual was unable to lift or move either leg in any direction. Moreover, it was not possible to manually lift the individual out of the 2.5 foot defluidized bed. To remove the individual, the bed was re-fluidized and a ladder was placed vertically into the fluidized bed near the immobilized subject. With the bed re-fluidized, the individual was only then able to climb out the bed using the ladder in the same way, and with the same ease, as climbing out of a swimming pool with a ladder. The individual did not sustain any injury or discomfort upon being detained and trapped by the fluid bed. The experiment was repeated a second time with identical results.

From the above examples, it is readily apparent that the fluid bed configurations of the present invention provides a relatively rapid and potentially non-lethal option for immobilizing third parties. The fluid bed configurations of the invention can be adjusted to provide varying degrees of immobilization as demonstrated by the above examples. Thus, one skilled in the art following the teachings of the invention will be able to adjust the parameters of the fluid bed configurations to provide security enhancements for a variety of security applications.

It will thus be seen that the objects set forth above, among those made apparent from the preceding description, are efficiently attained and, since certain changes may be made in carrying out the method and in the construction set forth without departing from the spirit and scope of the invention, it is intended that all matter contained in the above description and shown in the accompanying drawings shall be interpreted as illustrative and not in a limiting sense.

What is claimed is:

1. A method of inhibiting access to a location by a third party, the steps comprising:

forming an enclosure, said enclosure having an opening;

placing a gas distribution piping array in said enclosure;

placing fluidizable granular solids in said enclosure in a surrounding relationship to said gas distribution piping array;

connecting a gas flow generator to said gas distribution piping array;

activating said gas flow generator to fluidize said fluidizable granular solids when said third party approaches or is located at said opening; and deactivating said gas flow generator to defluidize said fluidizable granular solids after said third party is at least partially immersed in said granular solids.

2. The method of claim 1, further comprising the step of restricting movement of said third party.

3. The method of claim 1, further comprising the step of reactivating said gas flow generator to fluidize said fluidizable granular solids to allow removal of said third party from said fluidizable granular solids in said first enclosure.

4. The method of claim 1, further comprising the step of detecting the presence of said third party.

5. The method of claim 4, wherein said detecting step occurs prior to said activating step.

6. The method of claim 1, wherein said fluidizable granular solids having a range of 40 to 100 U.S. Mesh particle size.

7. The method of claim 5, wherein said fluidizable granular solids having a range of 60 to 80 U.S. Mesh particle size.

8. The method of claim 1, further comprising the step of positioning at least a majority of said enclosure in ground having a surface area, wherein said opening of said enclosure is substantially level with and adjacent to said surface area.

9. The method of claim 8, further comprising the step of providing a support structure at said opening of said enclosure.

10. The method of claim 9, wherein said support structure is a metallic grating.

11. The method of claim 9, wherein said support structure has a size smaller than said opening of said enclosure such that said support structure falls into said enclosure when said fluidizable granular solids are fluidized.

12. The method of claim 11, wherein said support structure is adapted to fall into said enclosure at a rate equal to or greater than the rate at which said third party traverses said opening.

13. The method of claim 1, further comprising the step of providing a retaining structure along a perimeter of said first enclosure.

14. The method of claim 13, further comprising the step of providing a guiding structure to control a vehicle entering the enclosure when said granular solids are fluidized.

15. The method of claim 1, wherein said gas flow generator is a blower.

16. The method of claim 1, wherein said gas flow generator is an air compressor fluidly connected to a pressurized tank.

17. A method of inhibiting access to a location by a third party, the steps comprising:

disposing a fluid bed configuration in a space leading to said location, said space being defined by a perimeter and a volume, and said fluid bed configuration having a gas distribution piping array and a plurality of fluidizable granular solids;

connecting a gas flow generator to said gas distribution piping array;

detecting the presence of said third party;

activating said gas flow generator to discharge gas and fluidize said granular solids; and deactivating said gas flow generator to defluidize said granular solids after said third party is at least partially immersed in said granular solids.

18. The method of claim 17, wherein a majority of said volume is disposed below a defined surface area.

19. The method of claim 18, wherein said perimeter is substantially flush with said defined surface area.

20. The method of claim 19, further comprising the step of filling said space with fluidizable granular solids to form a surface that is substantially parallel to said defined surface area.

21. The method of claim 17, further comprising the step of immobilizing said third party in said plurality of fluidizable granular solids.

22. The method of claim 21, further comprising the step of reactivating said gas flow generator to remove said third party from said plurality of fluidizable granular solids.

23. A method of immobilizing a vehicle comprising the steps of:

providing an enclosure proximal to a defined surface area, said enclosure defined by an open perimeter and a depth;

placing a gas distribution array in said enclosure;

forming a bed of granular solids in said enclosure;

connecting a gas flow generator to said gas distribution array;

activating said gas flow generator to fluidize said granular solids when said vehicle is at bed of granular solids or at said defined surface area; and deactivating said gas flow generator after said vehicle is at least partially immersed in said bed.

24. The method of claim 23, wherein said vehicle has a plurality of doors, and said depth is large enough so that said doors of said vehicle cannot be fully opened after deactivating said gas flow generator.

25. The method of claim 23, wherein said depth is large enough so that said vehicle is partially buried in said bed after deactivating said gas flow generator.

26. The method of claim 23, further comprising the step of providing a guiding structure to control the path of said vehicle upon entering said bed.

27. The method of claim 23, further comprising the step of providing a retaining structure to inhibit collapse of said enclosure.

* * * * *